US006679172B2

(12) United States Patent
Tokiwa

(10) Patent No.: US 6,679,172 B2
(45) Date of Patent: Jan. 20, 2004

(54) CONTROL APPARATUS AND METHOD FOR AUTOMATICALLY CHANGING PLATE CYLINDERS IN ROTARY PRESS

(75) Inventor: Shizurou Tokiwa, Zushi (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/170,075

(22) Filed: Jun. 12, 2002

(65) Prior Publication Data

US 2003/0041766 A1 Mar. 6, 2003

(30) Foreign Application Priority Data

Aug. 31, 2001 (JP) ..... 2001-263377

(51) Int. Cl.[7] ..... B41F 33/00; B41F 5/16; B41F 9/02

(52) U.S. Cl. ..... 101/484; 101/180; 101/218

(58) Field of Search ..... 101/484, 178, 101/179, 180, 181, 218

(56) References Cited

U.S. PATENT DOCUMENTS 3,139,025 A * 6/1964 Chambon ..... 101/192
4,240,346 A * 12/1980 Landis et al. ..... 101/139
5,617,788 A * 4/1997 Horiguchi et al. ..... 101/181
5,970,870 A 10/1999 Shiba et al.

FOREIGN PATENT DOCUMENTS

JP 8-207233 8/1996
JP 08207233 8/1996

* cited by examiner

*Primary Examiner*—Andrew H. Hirshfeld
*Assistant Examiner*—Hoai-An D. Nguyen
(74) *Attorney, Agent, or Firm*—McGlew and Tuttle, P.C.

(57) ABSTRACT

The control apparatus, in a rotary press having a plurality of printing units, performs a first calculation of subtracting the number of effective copies from the required number of copies for an operating printing unit and a second calculation of subtracting the number of copies of the operating printing unit from the result of the first calculation until a standby printing unit being ready to be operated, then outputs a first signal when the second calculation results 0 or less, a second signal when the first calculation results 0 or less, a control message to accelerate the printing unit to a predetermined operation speed to the printing control unit of the standby printing receiving the first signal, and a control message to decelerate and stop the printing unit to the printing control unit of the operating printing unit receiving the second signal.

10 Claims, 6 Drawing Sheets

SFTX
MCA1
GCCS
I11
I12
I15
I16
I31
I32
I35
I36
IEXB
IECC
IECC
IECC

CONTROL APPARATUS AND METHOD FOR AUTOMATICALLY CHANGING PLATE CYLINDERS IN ROTARY PRESS

CROSS-REFERENCE TO RELATED APPLICATIONS

This application claims priority from Japanese patent application Serial no. 2001-263377 filed Aug. 31, 2001, the contents of which are incorporated by reference herein.

BACKGROUND OF THE INVENTION

1. Field of the Invention

This invention relates to a control apparatus for automatically changing plate cylinders for use in a rotary press comprising a plurality of printing sections; each printing section having a plate cylinder and ink feeding means for feeding ink to a printing plate surface on the outer peripheral surface of the plate cylinder, independent printing drive means for driving at least a plate cylinder, a first state changing unit for independently changing at least each plate cylinder from the printing state enabling printing to the non-printing state disabling printing, and a second state changing unit for independently changing each ink feeding means from the ink feeding state enabling ink feeding to the ink non-feeding state disabling ink feeding; the plate cylinder that may be in printing operation being automatically changed so that a preceding printing operation can be continuously taken over without stopping the rotary press by a succeeding printing operation where a printing material having in whole or in part different printing contents form those printed in the preceding printing operation is printed.

2. Description of the Related Art

A rotary press comprising a plurality of printing sections so that a preceding printing operation can be continuously taken over without stopping the rotary press by a succeeding printing operation where a printing material having in whole or in part different contents from those printed in the preceding printing operation is printed by changing plate cylinders being used for printing operation has been disclosed in Japanese Published Unexamined Patent Application No. Hei-8 (1996) -207233, for example.

This rotary press comprises a plurality of printing sections; each printing section having at least independent drive means for driving the plate cylinder thereof, and a unit for independently changing over each plate cylinder from a printable state to an unprintable state or vice versa so that plate cylinders used in the preceding printing operation can be changed in part or in whole in the succeeding printing operation where a printing material having in part or in whole different contents from those printed in the preceding printing operation is printed.

In this rotary press, plate cylinder changing and speed adjustment for independently changing over each plate cylinder from a printable state to an unprintable state as necessary are accomplished by a control apparatus when changing over a preceding printing operation to a succeeding printing operation.

In Japanese Published Unexamined Patent Application No. Hei-8 (1996) -207233, no specific details about control using the control apparatus are disclosed. In particular, no specific details about control processing as to how a plate cylinder being changed over is designated when changing plate cylinders to independently change over each plate cylinder from a printable state to an unprintable state as necessary, or as to how the timing of actuating the plate cylinder that has been stopped and left in the unprintable state, increasing the speed thereof to match with the printing operation speed of the rotary press at that point of time is determined, are not disclosed.

In printing operation, the required number of print copies is determined in advance for each printing materials. The number of print copies prior to the changeover of plate cylinders therefore has to be set to the required minimum to minimize, or eliminate, unnecessary printing paper (spoilage). In the rotary press disclosed in Japanese Published Unexamined Patent Application No. Hei-8 (1996)-207233, it is not clear how these requirements can be satisfied.

SUMMARY OF THE INVENTION

It is an object of the present invention to provide rotary press control apparatus for use in a rotary press comprising a plurality of printing sections, in which the number of print copies prior to the changeover of plate cylinders can be reduced to the required minimum, making it possible to achieve printing with unnecessary printing paper (spoilage) minimized or eliminated, thus preventing printing cost from increasing due to generation of unnecessary printing paper (spoilage) in a printing operation where a preceding printing process can be continuously changed, without stopping the rotary press, to a succeeding printing operation where a printing material having in part or in whole different contents from those printed in the preceding printing operation is printed.

To achieve these objectives, the present invention provides a control apparatus for automatically changing plate cylinders for use in rotary press which provides a plurality of printing units, wherein each printing unit comprises at least a plate cylinder and an ink feeder to the printing plate surface on the outer periphery of the plate cylinder, a printing drive unit to drive at least a plate cylinder, a first state changing unit to individually change at least each plate cylinder from a printing state enabling printing to a non-printing state disabling printing, a second state changing unit to change each ink feeder from an ink feeding state enabling ink feeding to the printing plate surface to an ink non-feeding state disabling ink feeding, wherein the apparatus comprises; a reference control section performing an input operation of at least an operation instruction for a printing operation, such as start, acceleration/deceleration and stop, outputting a drive reference corresponding to the operation instruction, and selectively outputting a monotonously increasing reference speed that monotonously increases at a predetermined gradient and a monotonously decreasing reference speed that monotonously decreases at a predetermined gradient, aside from the outputting of the drive reference; a drive control section being provided for each printing drive unit for controlling the rotation of the printing drive unit on the basis of a signal from the reference control section; a printing control section setting a required number of print copies for a printing operation, carrying out a first calculation where "1" is subtracted from the required number of print copies for the printing operation every time a printing material is detected at a predetermined detecting position and a second calculation where a period of time for a currently stopped printing drive unit to be driven at the monotonously increasing reference speed and reach a printing operation speed at that point of time in the printing operation is calculated, calculating the number of printing materials to be printed when the printing operation at that point of time is continued for the calculated period of time, and subtracting at all times the sum of the calculated number of printing materials and a predetermined constant from the value obtained in the first calculation, outputting a first signal when a value obtained in the second calculation becomes less or equal "0," and outputting a second signal when a value obtained as the calculation result of the first calculation becomes less or equal "0;" and an operation control section outputting a state changing signal for operating the first state changing unit to change the state of plate cylinders, and the second state changing unit to change the state of the ink feeder, wherein the drive control section outputs the monotonously increasing reference speed in response to the output of the first signal in a predetermined relationship, and outputs the monotonously decreasing reference speed in response to the output of the second signal in a predetermined relationship, and the operation control section outputs an operation signal for operating the first state changing unit and the second state changing unit in response to the output of the second signal in a predetermined relationship.

Furthermore, the control apparatus according to the present invention may be characterized in that an reference control section designates a printing section to be used in a first printing operation or distinguishes and designates a printing section to be newly used and the printing section that has been designated for the preceding printing operation and is to be continuously used for each of the subsequent printing operations is provided.

Furthermore, the control apparatus according to the present invention may be characterized in that the printing control section is provided in such a manner that the number of effective printing materials upstream of a predetermined detecting position at which printing materials are detected can be set, and that the number of effective printing materials in the upstream can be subtracted from the required number of print copies during the first calculation.

Furthermore, the control apparatus according to the present invention may be characterized in that the reference control section is provided as a master control section, and the drive control section is provided as a slave control section subordinated to the master control section.

The present invention also provides a control method for automatically changing plate cylinders for use in a rotary press providing a plurality of printing units, wherein each printing unit comprises at least a plate cylinder and an ink feeder to the printing plate surface on the outer periphery of the plate cylinder, a printing drive unit to drive at least a plate cylinder, a first state changing unit to individually change at least each plate cylinder from a printing state enabling printing to a non-printing state disabling printing, a second state changing unit to change each ink feeder from an ink feeding state enabling ink feeding to the printing plate surface to an ink non-feeding state disabling ink feeding, the method comprises the steps of performing the input operation of at least an operation instruction for a printing operation, such as start, acceleration/deceleration and stop, outputting a drive reference corresponding to the operation instruction, and selectively outputting a monotonously increasing reference speed that monotonously increases at a predetermined gradient and a monotonously decreasing reference speed that monotonously decreases at a predetermined gradient, aside from the outputting of the drive reference, being provided for each printing drive unit for controlling the rotation of the printing drive unit on the basis of a signal from the reference control section, setting a required number of print copies for a printing operation, carrying out a first calculation where "1" is subtracted from the required number of print copies for the printing operation every time a printing material is detected at a predetermined detecting position and a second calculation where a period of time for a currently stopped printing drive unit to be driven at the monotonously increasing reference speed and reach a printing operation speed at that point of time in the printing operation is calculated, calculating the number of printing materials to be printed when the printing operation at that point of time is continued for the calculated period of time, subtracting at all times the sum of the calculated number of printing materials and a predetermined constant from the value obtained in the first calculation, outputting a first signal when a value obtained in the second calculation becomes less or equal "0," and outputting a second signal when a value obtained as the calculation result of the first calculation becomes less or equal "0;" and outputting a state changing signal for operating the first state changing unit for changing the state of plate cylinders, and the second state changing unit for changing the state of the ink feeding means feeding ink, wherein the drive control section outputs the monotonously increasing reference speed in response to the output of the first signal in a predetermined relationship, and outputs the monotonously decreasing reference speed in response to the output of the second signal in a predetermined relationship and the operation control section outputs an operation signal for operating the first state changing unit and the second state changing unit in response to the output of the second signal in a predetermined relationship.

In one preferred mode, the present invention starts the control apparatus for automatically controlling plate cylinders according to the present invention prior to a printing operation, enters into the printing control section for memory at least information on printing cylinders being used and individual printing information including the required number of print copies for each of several printing operations scheduled to be continuously operated. The reference control section receives the printing information, and combines the drive control sections for the drive means to be controlled in that printing operation and designates them as a group.

Upon completion of group designation, the printing operation is started. The printing operation is carried out as the drive means are driven via the drive control section on the basis of the drive reference output by the reference control section in accordance with the operation instructions from the input processing section.

As the printing operation is started, a printing material is detected at a predetermined position and subtracted from the required number of print copies in the printing control section. At the printing control section, the drive reference output by the reference control section is input at all times and the printing operation speed at that point of time is recognized. At the same time, when the drive means that has been stopped at that point of time is driven via the drive control section on the basis of the "monotonously increasing reference speed" output by the reference control section, the time required until the drive means reaches the printing operation speed at that point of time is calculated, and the number of printing materials printed when the printing operation at that point of time is continued as long as the calculated time.

Then, the calculated number of printing materials and a predetermined constant (integer), which will be described later, are subtracted from the aforementioned required number of print copies. When the value obtained by subtracting the detected number of printing materials, the calculated number of printing materials and the predetermined constant (integer) from the required number of print copies becomes less or equal "0," the printing control section outputs a first signal. Furthermore, when the value obtained by subtracting only the detected number of printing materials from the required number of print copies becomes less or equal "0," the printing control section outputs a second signal.

Or, the first signal and the second signal mentioned above are output at the point of time when the value obtained by subtracting the number of effective printing materials upstream of a predetermined detecting position at which printing materials are detected, together with them, from the required number of print copies becomes less or equal "0." As the aforementioned predetermined constant (integer), used is a number slightly greater than the number of printing material to be printed at the maximum printing operation speed during the period of time required for the drive means that has been driven from the stopped state at that point of time at the "monotonously increasing reference speed" and reached the printing operation speed at that point of time to be phase-adjusted to match with the phase of the drive reference signal so that the drive means comes to have a phase in which printing operation is possible.

Upon receipt of the first signal, the reference control section outputs a "monotonously increasing reference speed" to the drive control section corresponding to the drive means so as to start the drive means of the printing section that has not been used in the current printing operation and is to be used in the next printing operation, and increase the speed thereof to the printing operation speed at that point of time.

As a result, the drive control section to which the "monotonously increasing reference speed" is input actuates the corresponding drive means in accordance with the "monotonously increasing reference speed" to increase the speed of the drive means. As the "monotonously increasing reference speed" agrees with the reference speed of the "drive reference" output by the drive control section, then the drive control section changes over the output to the drive control section to which the "monotonously increasing reference speed" has been input to the "drive reference" so as to control the rotation of the drive means corresponding to the drive control section on the basis of the "drive reference."

Not only the drive means but also the printing cylinders, such as the plate cylinders, that have been shifted to the control on the basis of the drive reference output by the reference control section are controlled so as to be operated in a phase enabling printing operation. After the drive means, that is, the aforementioned printing cylinders have been controlled so as to be operated in a phase enabling printing operation, a second signal is output. The second signal is input into the operation control section and the reference control section.

Upon receipt of the second signal, the operation control section actuates the second state changing unit of the printing section that has been used in the current printing operation and is not to be used in the next printing operation so as to change into an ink non-feeding state, and at the same time actuates the second state change unit of the printing section that has not been used in the current printing operation and is to be used in the next printing operation to change into an ink feeding state.

The operation control section then actuates the first state changing unit of the printing section that has not been used in the current printing operation and is to be used in the next printing operation to change into a printing state, and at the same time actuates the first state changing unit of the printing section that has been used in the current printing operation and is not to be used in the next printing operation to change into a non-printing state.

When the first state changing unit of the printing section that has been used in the current printing operation and is not to be used in the next printing operation is changed to a non-printing state, the reference control section outputs a "monotonously decreasing reference speed" to the drive control section corresponding to the drive means of the printing section that has been used in the current printing operation and is not to be used in the next printing operation so as to stop that drive means. The drive control section to which the "monotonously decreasing reference speed" is input decelerates and stops the corresponding drive means in accordance with the "monotonously decreasing reference speed."

BRIEF DESCRIPTION OF THE DRAWINGS

These and other objects, aspects, features and advantages of the present invention will better be understood from the following detailed description and the drawing attached hereto showing certain illustrative embodiments of the present invention. In this connection, it should be noted that such embodiments as illustrated in the accompanying drawings are intended in no way to limit the present invention, but to facilitate an explanation and understanding thereof.

DETAILED DESCRIPTION OF THE PREFERRED EMBODIMENTS

Figure 1:
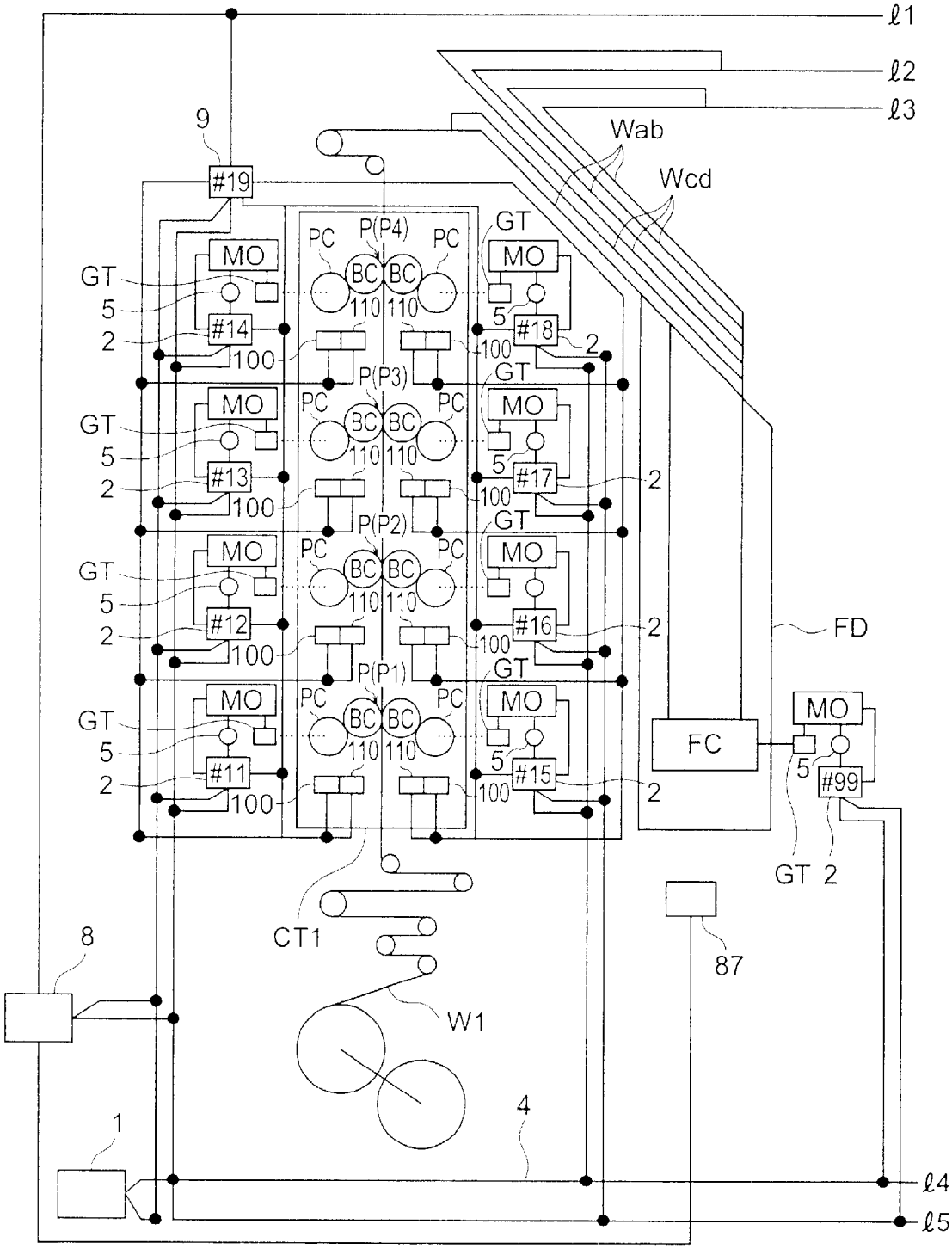
FIG. 1 is a schematic diagram showing part of an embodiment of the present invention.
Figure 2:
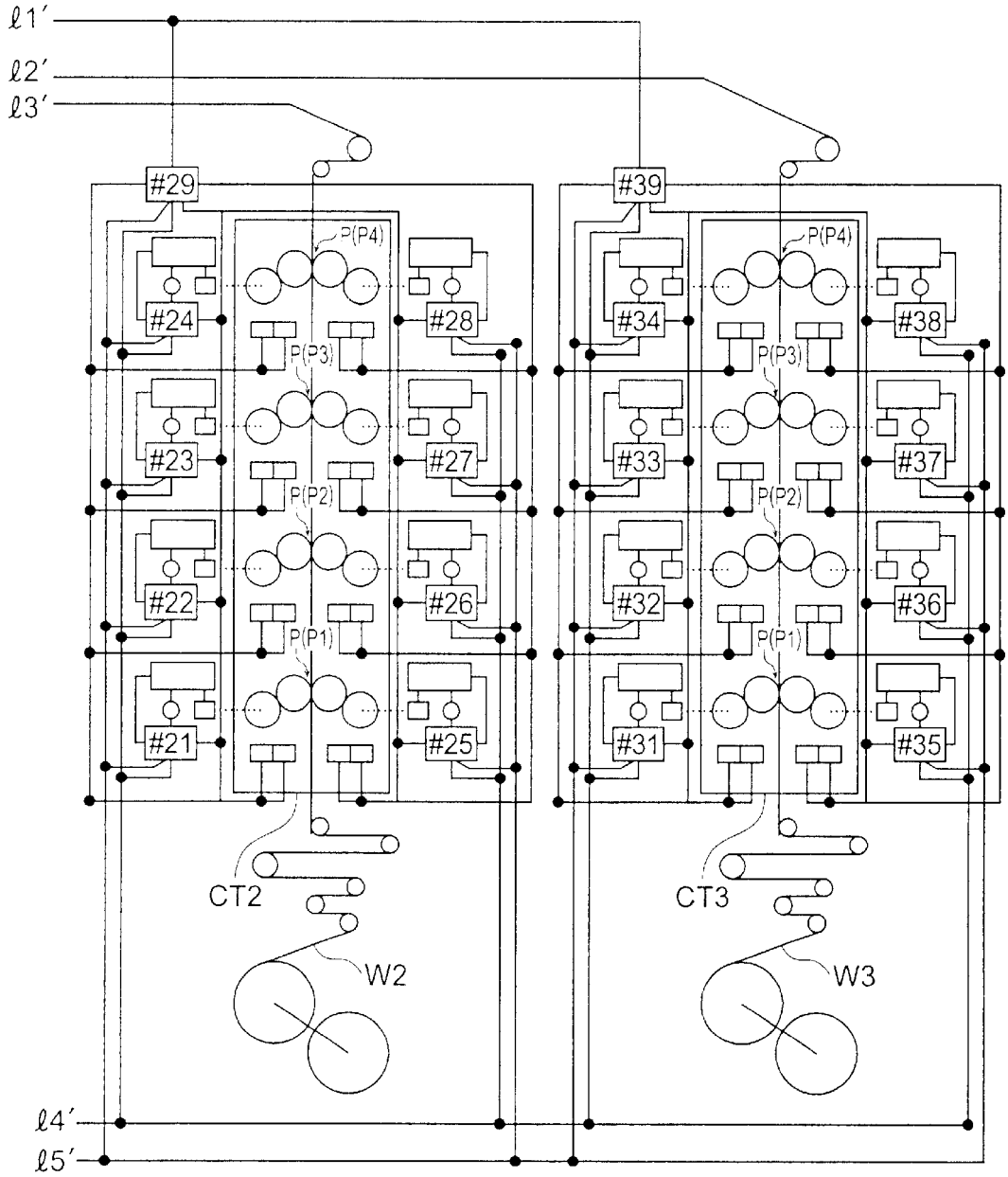
FIG. 2 is a schematic diagram showing part of an embodiment of the present invention, the left end thereof being connected to the right end of FIG. 1 to form the entire construction.

FIG. 1 is a schematic diagram showing part of an embodiment of the present invention. FIG. 2 is a schematic diagram showing part of an embodiment of the present invention, the left end thereof being connected to the right end of FIG. 1 to form the entire construction. Network lines 4 in FIGS. 1 and 2 are connected at points l 1, l 2, l 3, l 4 and l 5 in FIG. 1 and l 1', l 2', l 3', l 4', and l 5' in FIG. 2, respectively.

Both FIGS. 1 and 2 show an outline of a newsprint rotary press to which an embodiment of the present invention is applied.

This rotary press comprises multicolor printing units CT1 through CT3 each having four printing sections P (P1, P2, P3 and P4), and a folding unit FD for cutting and folding a printed paper web W into a predetermined number of printed images.

Each printing section P has two sets of printing couples comprising a plate cylinder PC and a blanket cylinder BC, both disposed in such a manner as to contact each other, with the respective blanket cylinders of the printing couples disposed in such a manner as to contact each other. In the case of a newsprint rotary press, for example, the printing couple has a width enough to print four pages of newspaper in a single horizontal row. A divided paper web Wcd obtained by dividing a paper web W having printed images across the entire width thereof at the center of the width in such a manner as to have images printed with one across-the-width half of the printing cylinder (which refers to both the plate cylinder PC and the blanket cylinder BC collectively, or where no specific distinction is needed between them) of the printing section P is overlaid on another divided paper web Wab having images printed with the other across-the-width half of the printing cylinder of the printing section P using a turn bar device (not shown), and all the divided paper webs Wab and Wcd printed on each of the multicolor printing units CT1 through CT3 are overlaid and guided to the folding unit FD where a copy of newspaper is prepared.

Each printing couple is adapted to be driven by drive means MO, with the plate cylinder PC via transmission means GT, and the blanket cylinder BC via the plate cylinder PC and transmission means (not shown) provided between the plate cylinder PC and the blanket cylinder BC.

The plate cylinder PC and the adjoining blanket cylinder BC of each printing section P are connected to a first state changing unit 100 comprising a printing cylinder contacting/detaching unit and a fluid-pressure cylinder in such a manner that the plate cylinder PC can make contact with and detached from the adjoining blanket cylinder BC, and that the blanket cylinder BC can be make contact with and detach from the adjoining plate cylinder PC and the blanket cylinder BC.

The printing cylinder contacting/detaching unit is driven by a fluid-pressure cylinder and caused to move between a position at which the plate cylinder PC and the blanket cylinder BC make contact with the adjoining cylinders (printing position) and a position at which at least the plate cylinder PC detaches from the adjoining blanket cylinder BC (non-printing position).

The folding unit FD is driven by the means MO, with the folding cylinder FC via the transmission means GT, and the other cylinders via transmission means (not shown) provided between the folding cylinder FC and the other cylinders. There may be a construction where the output shaft of the drive means MO directly drives the plate cylinder PC or the folding cylinder FC by eliminating the transmission means GT interposed between the drive means MO and the plate cylinder PC or the folding cylinder FC.

Figure 4:
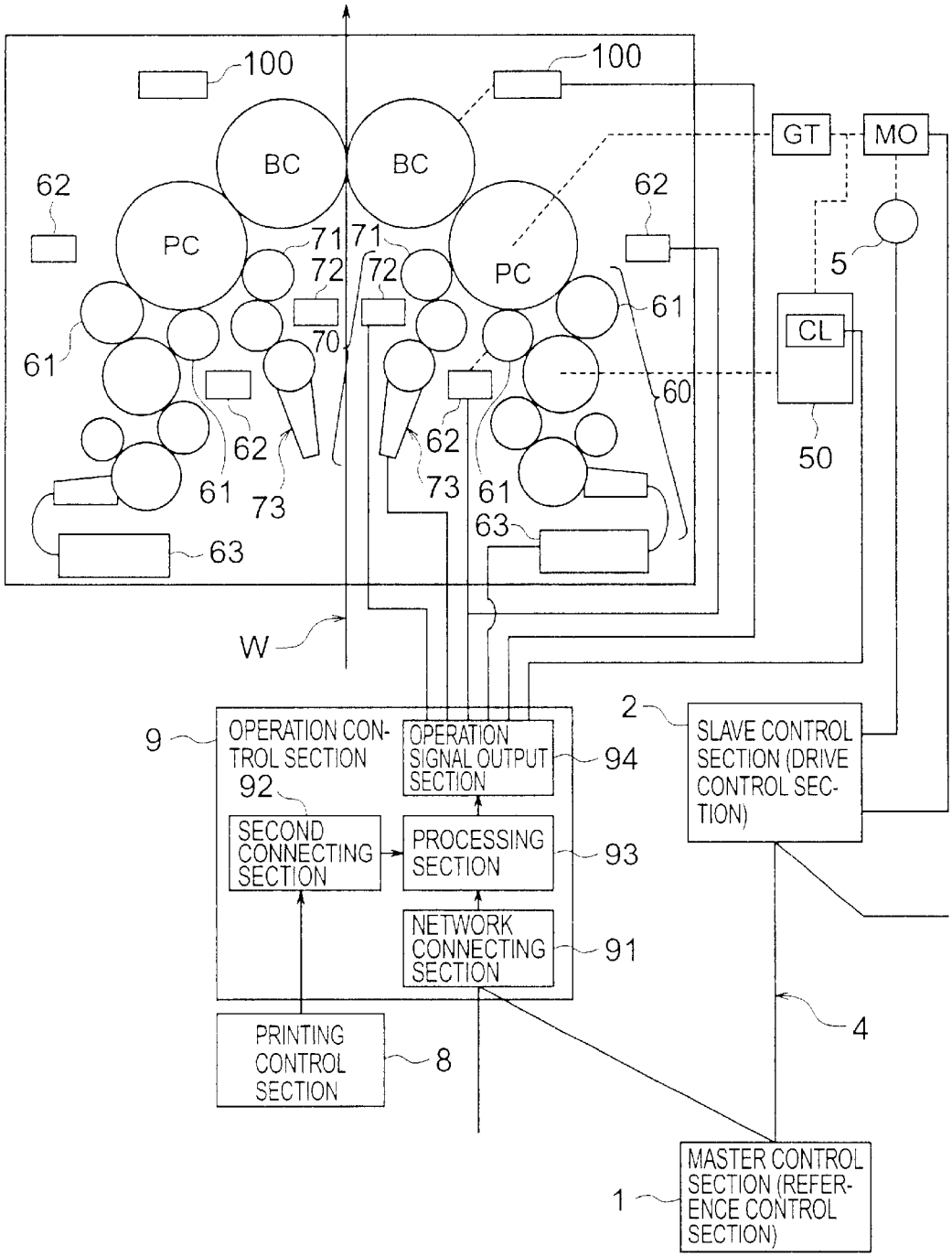
FIG. 4 is a schematic block diagram of a printing couple in an embodiment of the present invention.

As shown in FIG. 4, each printing couple has an inking arrangement 60 and a dampening arrangement 70.

The inking arrangement 60 and the dampening arrangement 70 are connected to inking transmission means 50 having a power connecting unit CL that is a clutch, for example, This inking transmission means 50 is provided in such a manner that the inking transmission means 50 can be connected to and disconnected from the drive means MO of the printing couple with the power connecting unit CL.

Form rollers 61 and 61 of the inking arrangement 60 are connected to a form roller contacting/detaching unit 62 that is driven by a fluid-pressure cylinder and constitutes part of the second state changing unit 110 so that each of the form rollers 61 and 61 can make contact with and detach from the printing plate surface of the plate cylinder PC, and are caused to move between a position at which the form rollers 61 and 61 make contact with the printing plate surface of the plate cylinder PC (ink-feeding position at which ink is fed to the printing plate surface) and a position at which the form rollers 61 and 61 detach from the printing plate surface of the plate cylinder PC (ink non-feeding position at which ink is not fed to the printing plate surface).

Similarly, a form damping roller 71 of a dampening arrangement 70 is connected to a form damping roller contacting/detaching unit 72 that is driven by a fluid-pressure cylinder and constitutes part of the second state changing unit 110 in such a manner as to make contact with and detach from the printing plate surface of the plate cylinder PC, and is caused to move between a point at which the form damping roller 71 makes contact with the printing plate surface of the plate cylinder PC (damping water feeding position at which damping water is fed to the printing plate surface) and a position at which the form damping roller 71 detaches from the printing plate surface of the plate cylinder PC (damping water non-feeding position at which damping water cannot be fed to the printing plate surface).

Furthermore, ink pump groups 63 driven by stepping motors (not shown) are provided in the inking arrangement 60, and dampening water injection nozzle groups 73 whose nozzles are opened and closed with solenoids, for example, are provided in the dampening arrangement 70. The ink pump groups 63 and the dampening water injection nozzle groups 73 are operated when the second state changing unit 110 is in a state in which ink and dampening water can be supplied.

In the drive means MO of the aforementioned printing couple and the drive means MO of the folding unit FD provided are slave control sections that are drive control sections indicated by #11~#18, #21~#28, #31~#38, and #99 corresponding to the drive means MO, and rotary encoders with a Z-phase outputs (hereinafter simply referred to as encoders) 5 that output a pulse signal for an angular displacement of a predetermined angle and a Z-phase signal for each turn; the slave control sections 2 being connected to a network line 4 via a slave network connecting section 21 as described in FIG. 3.

To the network line 4 also connected are a master control section 1 that is a reference control section, the printing control section 8, and operation control sections indicated by #19, #29 and #39 that correspond to the multicolor printing units CT1, CT2 and CT3. There can be a construction where a plurality of master control sections each having the functions of the master control section 1, which will be described later, are provided, in place of the master control section 1, so that the master control sections can be used by selectively switching them.

The network line 4 is formed into a loop so that even when any one of the network line 4 fails due to some troubles, signal transmission between the master control section 1 and the slave control sections 2 of #11~#18, #21~#28, #31~#38, and #99 and the operation control sections 9 of #19, #29 and #39 can be maintained with any other of the network line 4.

Moreover, the printing control section 8 and the operation control section 9 are connected to each other.

Figure 3:
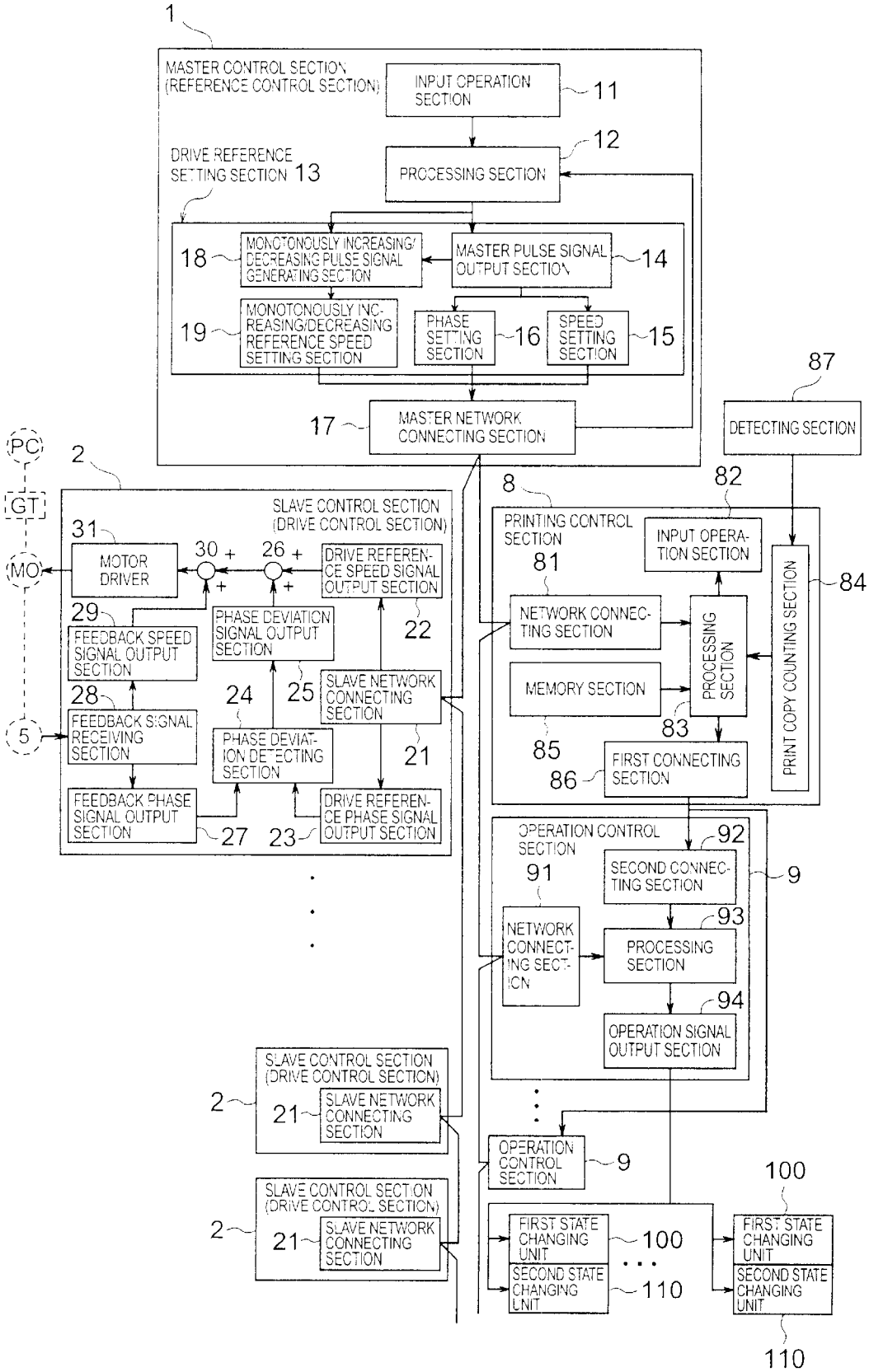
FIG. 3 is a schematic block diagram showing an embodiment of the present invention, with the master control section, the slave control section, the printing control sections and the operation control section connected to form the entire construction.

FIG. 3 shows a typical state of connection of the master control section 1, the slave control section 2, the printing control section 8 and the operation control section 9.

In FIG. 3, the master control section 1 has an input operation section 11, a processing section 12, a drive reference setting section 13, and a master network connecting section 17.

The input operation section 11 is capable of performing operations to input at least operation signals, such as start, acceleration/deceleration and stop.

The processing section 12 receives specific printing information for each printing operation from the printing control section 8 via the master network connecting section 17, organizes sets of printing sections P, P, - - - being used for each printing operation to be carried out continuously on the basis of the specific printing information, combines into groups for each set the slave control section 2 that is the drive control section of the drive means MO belonging to that set, the first state changing unit 100, and the second state changing unit 110 that are needed to be operated among the printing sections P, P, - - - to be used for that printing operation, and prepares a group designation message.

The processing section 12 enables the operation of the input operation section 11 so that the drive means MO of the organized sets are synchronously controlled, and sets a drive speed value on the basis of this operation. The processing section 12 also instructs the outputting of the monotonously increasing reference speed and the monotonously decreasing reference speed on the basis of the first and second signals output by the printing control section 8 as the printing operation proceeds.

The master network connecting section 17 transmits the group designating message prepared by the processing section 12 to the network line 4, also transmits a control message relating to drive reference values set by the drive reference setting section 13, and receives a response message that is response information sent from the slave control section 2 and the operation control section 9 via the network line 4.

The drive reference setting section 13 has a master pulse signal output section 14, a speed setting section 15, a phase setting section 16, a monotonously increasing/decreasing pulse signal generating section 18, and a monotonously increasing/decreasing reference speed setting section 19.

The master pulse signal output section 14 outputs a first master pulse signal proportional to the drive speed value set by the processing section 12 on the basis of the operational signals, such as start, acceleration/deceleration and stop, input by the input processing section 11, and outputs a second master pulse signal every time a predetermined number of first master pulse signals are output.

The first and second master pulse signals are signals of a frequency equal to the pulse signal output by the encoder 5 provided corresponding to the drive means MO when the multicolor printing unit is caused to operate at a predetermined speed.

The speed setting section 15 sets a drive reference speed for the drive means MO on the basis of the first master pulse signal output by the master pulse signal output section 14.

The phase setting section 16 sets the drive reference phase for a printing cylinder, such as a plate cylinder PC, to be driven by the drive means MO on the basis of the first master pulse signal and the second master pulse signal output by the master pulse signal output section 14.

The monotonously increasing/decreasing pulse signal generating section 18 generates and outputs a monotonously increasing pulse signal for monotonously increasing the drive means MO or a monotonously decreasing pulse signal for monotonously decreasing the drive means MO, that is, a pulse signal the number of outputs of which per unit time increases or decreases at a certain rate, on the basis of the first master pulse signal output by the master pulse signal output section 14.

The monotonously increasing/decreasing reference speed setting section 19 sets speeds to monotonously increase or decrease, that is, increase or decrease at a certain rate, the rotation of the drive means MO on the basis of the monotonously increasing pulse signal or the monotonously decreasing pulse signal output by the monotonously increasing/decreasing pulse signal generating section 18.

The slave control section 2 has a slave network connecting section 21, a drive reference speed signal output section 22, a drive reference phase signal output section 23, a feedback signal receiving section 28, a feedback speed signal output section 29, a feedback phase signal output section 27, a phase deviation detecting section 24, a phase deviation signal output section 25, a first speed signal correcting section 26, a second speed signal correcting section 30 and a motor driver 31.

The slave network connecting section 21 is a microcomputer including an interface for receiving group designating messages comprising set organizing information transmitted by the master control section 1, and control messages, such as drive references comprising drive reference speeds and drive reference phases, via the network line 4, and transmits to the master control section 1 response messages acknowledging the receipt of messages from the master control section 1 as necessary.

The drive reference speed signal output section 22 converts the drive reference speed, the monotonously increasing reference speed and the monotonously decreasing reference speed in the control message into a drive reference speed signal that is an analog signal that is proportional to the speed value set by the processing section 12 on the basis of the input signal input by the input operation section 11, and the speed value generated and set in accordance with the instruction from the processing section 12 on the basis of the first and second signal outputs by the printing control section 8, which will be described later, and outputs it.

The drive reference phase signal output section 23 receives the drive reference phase of the control massage. Every time the drive reference phase is input, the drive reference phase signal output section 23 corrects the phase by a predetermined amount so that the printed image printed by the printing couple maintains a correct positional relationship with the cutting position by the folding unit FD on the basis of the web feed path length from each printing couple to the cutting position of the folding unit FD and the phase of the plate cylinder PC and the encoder 5 of the printing couple, both linked to each other via the drive means MO, so that the printed image printed by the printing couple can maintain a correct relationship with the cutting position by the folding unit FD, and outputs the corrected phase as the drive reference phase in the form of an appropriate signal. The drive reference phase signal output section 23 of the slave control section 2 of #99 that controls the drive means MO for the folding cylinder FC of the folding unit FD outputs the input drive reference phase as a drive reference phase in the form of an appropriate signal.

The feedback signal receiving section 28 receives the pulse signal and the Z-phase pulse signal output by the encoder 5 corresponding to the drive means MO.

The feedback speed signal output section 29 calculates a value proportional to the rotational speed of the drive means MO on the basis of the pulse signal output by the encoder 5, and converts it into a drive speed signal that is an analog signal proportional to the rotational speed of the drive means MO and outputs it.

The feedback phase signal output section 27 detects the rotational phase of a printing cylinder, such as a plate cylinder PC, that is a driven part, from the pulse signal output by the encoder 5, and outputs it in the form of an appropriate signal.

The phase deviation detecting section 24 detects a deviation of the phase of the printing cylinder with respect to the drive reference phase from the drive reference phase signal output by the drive reference phase signal output section 23 and the phase signal of the printing cylinder (the plate cylinder PC, for example) output by the feedback phase signal output section 27.

The phase deviation signal output section 25 is a proportional plus integral amplifier that converts the deviation detected by the phase deviation detecting section 24 into an analog phase deviation signal for output.

The first speed signal correcting section 26 corrects the drive reference speed signal output by the drive reference speed signal output section 22 by the phase deviation signal output by the phase deviation signal output section 25.

The second speed signal correcting section 30 corrects the first corrected speed signal corrected by the first speed signal correcting section 26 by the drive speed signal for the drive means MO output by the feedback speed signal output section 29.

The motor driver 31 supplies drive power to the drive means MO the motor driver 31 itself controls on the basis of the second corrected speed signal after corrected by the second speed signal correcting section 30.

The printing control section 8 has a network connecting section 81, an input operation section 82, a processing section 83, a printing copy counting section 84, a memory section 85 and a first connecting section 86. The print copy counting section 84 is connected to detecting section 87 provided at a predetermined printing material detecting position.

The network connecting section 81 is a microcomputer including an interface for receiving group designating messages comprising set organizing information transmitted by the master control section 1, and control messages, such as drive references comprising drive reference speeds and drive reference phases, via the network line 4, and transmits to the master control section 1 via the network line 4 the data stored in the memory section 85 extracted by the processing section, which will be described later, and first and second signals output by the processing section 83. The network connecting section 82 inputs information contained in each received message to the processing section 83.

The input operation section 82 is capable of designating, prior to printing operation, at least those printing cylinders to be used for each printing operation of a certain number of printing operations scheduled to be performed continuously, and receiving the printing information for instructing the required number of print copies to be printed in that printing operation. The input operation section 82 also sets and inputs a predetermined constant to be used for calculation when the printing control section 8 outputs a first signal, as will be described later, and the number of effective printing materials upstream of a predetermined detecting position for detecting printing materials that is determined by the distance from the predetermined detecting position for detecting printing materials to the printing material discharging position of the folding unit FD. When the distance between the predetermined detecting position for detecting printing materials and the printing material discharging position of the folding unit FD is too close, or when the number of effective printing materials upstream of the predetermined detecting position for detecting printing materials is not so large, the setting of this value may be omitted, and the first calculation, which will be described later, may be performed by disregarding this value.

The processing section 83 stores the data input by the input operation section 82 in the memory section 85, performs a second calculation on the first signal output on the basis of the subtraction carried out by the print copy counting section 84, which will be described later, the "determined constant" and the "number of effective printing materials upstream of the predetermine detecting position for detecting printing materials" input by the input operation section 82, outputs a first signal on the basis of the second calculation results, and outputs a second signal on the basis of the first calculation results carried out by the print copy counting section 84.

The print copy counting section 84 is connected to detecting section 87 provided for detecting printing materials discharged from the folding unit FD, and the processing section 83. The processing section 83 extracts the required number of print copies for that printing operating from the memory section 85, sets a value obtained by subtracting the "number of effective printing materials upstream of the predetermined detecting position for detecting printing materials" from the required number of print copies, performs a first calculation of subtracting "1" from this value every time the detecting section 87 detects a printing material, and outputs the calculation results to the processing section 83.

The memory section 85 stores each data input by the input operation section 82 via the processing section 83.

The first connecting section 86 is an interface connecting the printing control section 8 to the operation control section 9 for inputting and outputting signals between the printing control section 8 and the operation control section 9.

The operation control section 9 has a network connecting section 91, a second connecting section 92, a processing section 93 and an operation signal output section 94.

The network connecting section 91 is a microcomputer including an interface for receiving group designating messages comprising set organizing information transmitted by the master control section 1, and control messages, such as drive references comprising drive reference speeds and drive reference phases, via the network line 4, and transmits to the master control section 1 response messages notifying the receipt of messages from the master control section 1 as necessary. The network connection section 91 also inputs information on each received message to the processing section 93.

The second connecting section 92 is an interface connecting the printing control section 8 to the operation control section 9 for inputting and outputting signals between the printing control section 8 and the operation control section 9. The second connecting section 92 also inputs received signals to the processing section 93.

The processing section 93 outputs operation signal output instruction signals for urging the operation signal output section 94 to output operation signals on the basis of the information on each message transmitted by the master control section 1 input by the network connecting section 91 and each signal transmitted by the printing control section 8 input by the second connecting section 92.

The operation signal output section 94 is an amplified signal output device for receiving the operation signal output instruction signal of the processing section 93, and outputting operation signals to operate the corresponding first state changing unit 100, and the second state changing unit 110.

Next, the operation of the automatic plate cylinder changing control device during the operation of a rotary press in connection with the present invention will be described in the following.

Prior to the printing operation of the rotary press, information relating to printing cylinders, such as at least printing cylinders being used, an inking arrangement 60 being used and a dampening arrangement 70 being used, and specific printing information, including the required number of print copies, for each printing operation to be carried out continuously are input into the printing control section 8. More specifically, aforementioned pieces of information are input from the input operation section 82, and stored in the memory section 85 via the processing section 83. The processing section 82 outputs the information on the aforementioned printing cylinders stored in the memory section 85 to the processing section 12 of the master control section 1 as a reference control section via the network connecting section 81.

In the master control section 1 that is a reference control section, the processing section thereof organizes sets of printing section P, P, - - - to be used for each printing operation to be performed continuously on the basis of the input information on printing cylinders, combines into groups for each set the slave control section 2 that is the drive control section of the drive means MO belonging to that set, the first state changing unit 100, and the second state changing unit 110 that are needed to be operated among the printing sections P, P, - - - to be used for that printing operation, prepares a group designation message, and transmits the message to each slave control section 2 and operation control section 9 via the master network connecting section 17 and the network line 4.

Now assume that two printing operations are to be performed continuously, for example, with the preceding printing operation involving printing on both surfaces of a paper web W1 with printing sections P1 and P2 of a multicolor printing unit CT1, printing on both surfaces of a paper web W2 with printing sections P1, P2, P3 and P4 of a multicolor printing unit CT2, and printing on both surfaces of a paper web W3 with printing sections P1 and P2 of a multicolor printing unit CT3, and the succeeding printing operation involving printing on both surfaces of the paper web W1 with a printing section P4 of the multicolor printing unit CT1, printing on both surfaces of the paper web W2 with the printing sections P1, P2, P3 and P4 of the multicolor printing unit CT2, printing on both surfaces of a paper web W3 with a printing section P3 of the multicolor printing unit CT3, and printing on one surface of the paper web W3 with the printing section P4.

Figure 5:
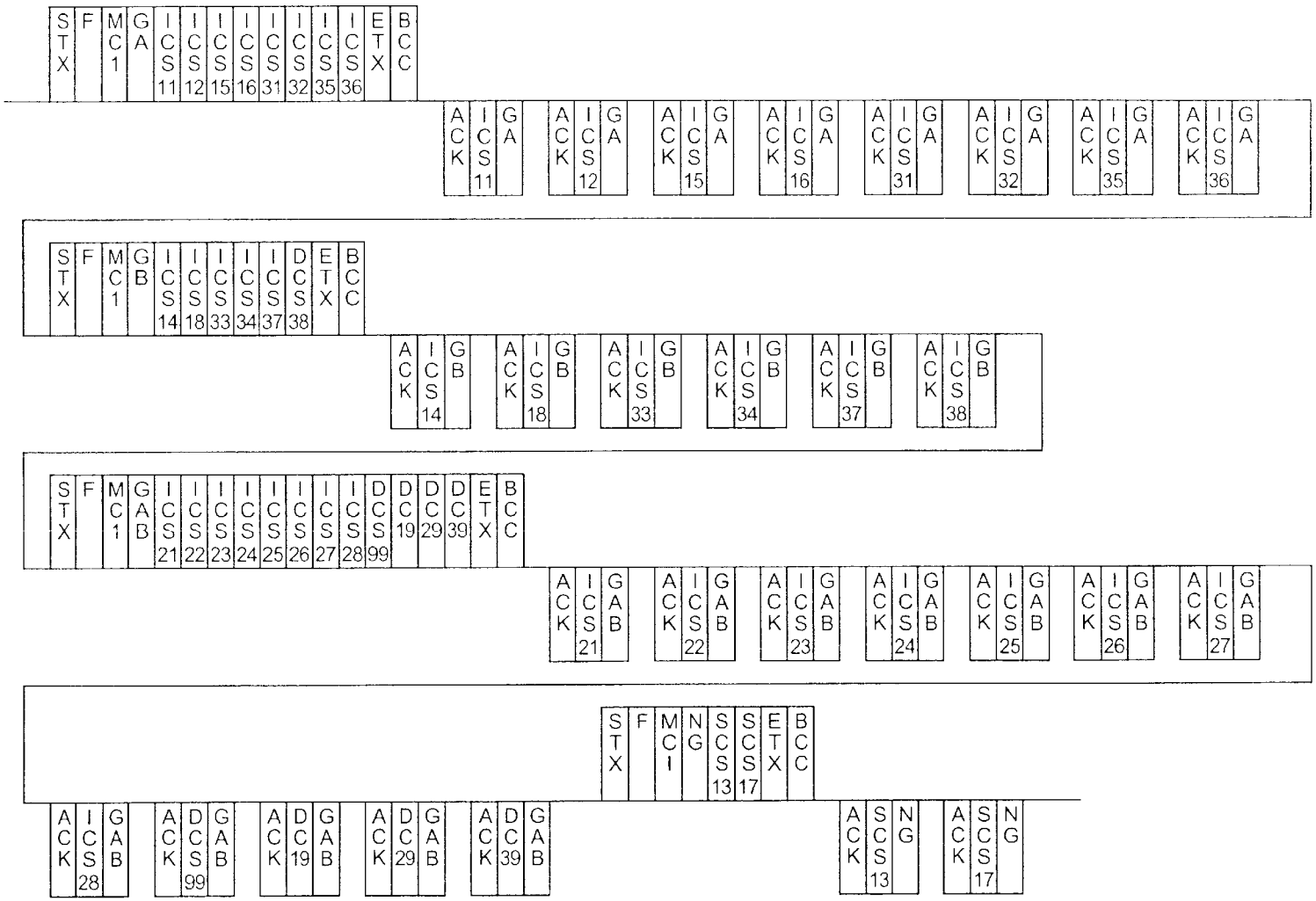
FIG. 5 is a diagram showing typical examples of a group designation message to be transmitted by the master control section, and response messages to it by the slave control section and the operation control section.

To perform the two printing operations, several codes, such as "F" denoting that this message designates a group, "MC1" denoting the master control section 1 as the message originator, any of "GA" code designating that the drive means MO belongs only to the preceding printing operation group, "GB" code designating that the drive means MO belongs only to the succeeding printing operation group, "GAB" code designating that the drive means MO belongs to both the preceding and succeeding printing operation groups, or "NG" code designating that the drive means MO does not involve any of these groups, a node number denoting the slave control sections of #11~#18, #21~#28, #31~#38 and #99 for each of the drive means MO of the printing couple being controlled, slave control section selecting codes "ICS11" through "DCS38" and "DCS99" comprising codes "I," "D" and "S" indicating that each slave control section 2 is an object designated as being "operative," or as being "non-operative," and that when a slave control section 2 is designated as "operative," the inking arrangement 60 and the dampening arrangement 70 of the printing couple are selected and designated as "operative," or as "non-operative," and operation control section selecting codes "DC19," "DC29" and "DC39" comprising node numbers indicating the operation control section 9 of #19, #29 and #39, are selectively inserted between the start code "STX" and end code "ETX" of a text message, as shown in FIG. 5, with a block check "BCC" suffixed to the text message. Note that the code "I" means that the printing couple in question is an object designated as "operative," and the inking arrangement 60 and the dampening arrangement 70 of that printing couple are selected and designated as "operative," "D" means that the printing couple in question is an object designated as "operative," but the inking arrangement 60 and the dampening arrangement 70 of that printing couple are selected and designated as "non-operative," and "S" means that the printing couple in question is an object designated as "non-operative."

Upon receipt of a group designating message, the slave network connecting section 21 of each slave control section 2 sends a response message acknowledging the receipt of the group designating message to the master control section 1 via the network line 4, and the network connecting section 91 of each operation control section 9 that receives the group designating message also sends a response message acknowledging the receipt of the group designating message to the master control section 1 via the network line 4.

The response message comprises slave control section response codes or operation control section response codes, consisting of "ACK" denoting that the message is a response message, a node number denoting the drive means MO of the responded slave control section 2 of a self-identifying node number of the responded operation control section 9, any of "GA," "GB" and "GAB" codes indicating to which group each slave control section 2 or operation control section 9 is designated as belonging, or "NG" code indicating that each slave control section 2 or operation control section 9 is not designated as belonging to any group. (Refer to FIG. 5).

Upon receipt of a group designating message, the processing section 93 of each operation control section 9 judges how the group designating message instructs the first state changing unit 100 and the second state changing unit 110 of the multicolor printing unit CT1, CT2 or CT3 corresponding to the operation control section 9 to operate, and output an operation signal output instruction signal at a timing which will be described later.

Upon completion of the above settings, the rotary press is ready to start a printing operation in which each group-designated drive means MO is synchronously controlled by the master control section 1.

Synchronously controlled printing operation is performed as operation signals, such as start, acceleration/deceleration, and stop, are input by the input operation section 11 of the master control section 1.

When operation signals, such as start and acceleration, are input to start a printing operation, the processing section 12 sets a speed value corresponding to the input operation signal in the master pulse signal output section 14 of the drive reference setting section 13. With this, the master pulse signal output section 14 outputs a first master pulse signal corresponding to the set speed, and outputs a second master pulse signal every time a predetermined number of the first master pulse signals are output. The first and second master pulse signals are signals of a frequency equal to the pulse signal output by the encoder 5 provided corresponding to the drive means MO of each printing couple and the Z-phase pulse signal output by the encoder 5.

As the master pulse signal output section 14 starts outputting the above signals, the speed setting section 15 and the phase setting section 16 of the drive reference setting section 13 integrate the pulse outputs output by the master pulse signal output section 14. That is, the speed setting section 15 integrates the aforementioned first master pulse signals, and the integrated value is cleared by the second master pulse signal.

The phase setting section 16 integrates the first and second master pulse signals, and the integrated value of the first master pulse signals is cleared by the second master pulse signal, while the integrated value of the second master pulse signals is cleared every time the integrated value reaches a predetermined value.

The predetermined value at which the integrated value of the second master pulse signals is determined in advance on the basis of the ratio between the number of revolution of a driven part (a plate cylinder PC, for example) and the number of revolution of the encoder 5; if the encoder 5 makes four (4) revolutions per revolution of the driven part, the predetermined value is "4." and if the encoder 5 makes one revolution per revolution of the driven part, the corresponding value is "1." In other words, the phase setting section 16 does not always have to count the second master pulse signals in the latter case.

The integrated values by the speed setting section 15 and the phase setting section 16 are transmitted in the form of a control message a predetermined intervals, at every 100 microseconds, for example, to the slave control section 2 which is an object designated as "operative" from the master network connecting section 17 via the network line 4.

Figure 6:
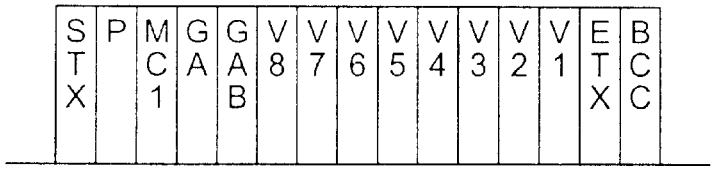
FIG. 6 is a typical example of a control message for driving and controlling the drive means corresponding to the slave control section belonging to each printing operation group.

The control message is a text message comprising "P" indicating that this message is a drive reference, "MC1" denoting the master control section 1 being controlled, "GA" and "GAB" codes designating groups being operated, "V8" through "V5" denoting drive reference speeds, and "V4" through "V1" denoting drive reference phases inserted between the start code "STX" and the end code "ETX" of a message; with a block check "BCC" suffixed to the text message, as shown in FIG. 6, for example. The "V8" through "V1" here comprise ASCII character sets of "0" to "9" and "A" to "F," and both the drive reference speed and the drive reference phase in the message shown consist of 4 bytes, for example.

These messages are transmitted over the network line 4 at a rate of 20 megabits per second, for example.

In each slave control section 2 that has received a control message, the drive reference speed is input into the drive reference speed signal output section 22, and the drive reference phase is input into the drive reference phase signal output section 23 for subsequent processing.

That is, the drive reference speed signal output section 22 to which the drive reference speed is input obtains a value S1 proportional to the speed value set by the processing section 12 by calculating the following equation.

$$S1=(Y2-Y1)/T$$

where Y2 is the drive reference speed that was input this time, Y1 is the drive reference speed that was input immediately before it, and T is the predetermined time interval in which the master control section 1 transmits a control message. The drive reference speed signal output section 22 then multiplies the value S1 by an appropriate constant and outputs an analog signal corresponding to the product as a drive reference speed signal. There may be a case, however, where S1<0 as the result of Y1>Y2 as the integrated value of the first master pulse signals of the speed setting section 15 is reset by the second master pulse signals. In such a case, the value S1 can be obtained by calculating the following equation.

$$S1=(Ym+Y2-Y1)/T$$

where Ym is the number of outputs of the first master pulses needed for the second master pulse signals to be output. Vm is a predetermined value.

The drive reference phase signal output section 23 to which the drive reference phase is input corrects the phase on the basis of the web feed path length from each printing couple to the cutting position of the folding unit FD and the imposition phase between the plate cylinder PC and the encoder 5 of the printing couple via the drive means MO so that the printed image printed by the printing couple can maintain a correct relationship with the cutting position by the folding unit FD, as noted earlier, and outputs the corrected phase as the drive reference phase in the form of an appropriate signal. The drive reference phase signal output section 23 of the slave control section 2 of #99 that controls the drive means MO for the folding cylinder FC of the folding unit FD outputs the input drive reference phase as a drive reference phase in the form of an appropriate signal.

In the slave control section 2, furthermore, the output pulse signal of the encoder 5 connected to the drive means MO corresponding to each slave control section 2 is input into the feedback signal receiving section 28. The output pulse signal of the encoder 5 inputs into the feedback signal receiving section 28 is processed in the feedback phase signal output section 27 and the feedback speed signal output section 29.

The feedback phase signal output section 27 integrates the pulse signal and Z-phase pulse signal output by the encoder 5, and outputs the integrated value in the form of an appropriate signal as the rotational phase value for the drive means MO. In the integration process by the feedback phase signal output section 27, the pulse signal integrated value is cleared by the Z-phase pulse signal, while the Z-phase signal integrated value is cleared every time the integrated value reaches a predetermined value. The predetermined value at which the Z-phase signal integrated value is cleared is determined in advance on the basis of the ratio between the number of revolution of the driven part and the number of revolution of the encoder 5, as in the case where the integrated value of the second master pulse signals is cleared in the phase setting section 16.

The feedback speed signal output section 29 integrates the pulse signal and Z-phase pulse signal output by the encoder 5, and obtained a value S2 proportional to the rotational speed of the drive means MO every time the slave network connecting section 21 receives a control message by calculating the following equation.

$$S2=(Y4-Y3)/T$$

where Y4 is the integrated value at that time, Y3 is the integrated value at the time when an immediately preceding control message is received, and T is the predetermined time interval in which the master control section 1 transmits a control message. The feedback speed signal output section 29 then multiplies the value S2 by an appropriate constant and outputs an analog signal corresponding to the product as the drive speed signal. There may be a case, however, where S2<0 as the result that Y3>Y4 as the integrated value of the pulse signals of the feedback speed signal output section 29 is reset by the Z-phase pulse signals. In such a case, the value S2 can be obtained by calculating the following equation.

$$S2=(Yn+Y4-Y3)/T$$

where Yn is the number of pulse signals output by the encoder 5 in the time interval in which the preceding and succeeding Z-phase pulse signals are output, equal to the number of outputs Ym of the first master pulse signals needed for the second master pulse signals to be output. Yn is a predetermined value.

Furthermore, every time the slave network connecting section 21 of the salve control section 2 receives a control message, the drive power fed from the motor driver 31 to the drive means MO is corrected. The details thereof are as follows.

Every time the slave network connecting section 21 receives a control message, the drive reference phase signal output section 23 outputs a drive reference phase signal, as noted earlier. This drive reference phase signal is input to the phase deviation detecting section 24.

The rotational phase value of the driven part output by the feedback phase signal output section 27, that is, the feedback phase signal, is also input into the phase deviation detecting section 24.

Every time the drive reference phase signal is input, the phase deviation detecting section 24 obtains a deviation between the drive reference phase and the rotational phase of the driven part from the drive reference phase signal and the feedback phase signal, and outputs the obtained deviation to the phase deviation signal output section 25 that is an integration amplifier. The phase deviation signal output section 25 output an analog signal corresponding to the aforementioned input deviation as a phase deviation signal.

The abovementioned drive reference speed signal is corrected with a phase deviation signal in the first speed signal correcting section 26 into a first corrected speed signal, and further corrected with a drive speed signal in the second speed signal correcting section 30 into a second corrected speed signal, which is input into the motor driver 31.

The motor driver 31 to which the second corrected speed signal is input corrects the drive power fed to the drive means MO so that the drive power matches with the second corrected speed signal.

Upon receipt of a control message, each operation control section 9 first outputs an operation signal output instruction signal so as to operate the ink pump group 63 corresponding to the inking arrangement 60 designated as operative and the dampening water injection nozzle group 73 corresponding to the dampening arrangement 70 designated as operative. This signal is amplified in the operation signal output section 94 to operate the corresponding ink pump group 63 and the dampening water injection nozzle group 73.

Every time the network connecting section 91 receives a drive reference, the network connecting section 91 inputs it to the processing section 93. Upon receipt of the drive reference, the processing section 93 judges the drive reference speed, and as the drive reference speed reaches a predetermined speed, outputs an operation signal output instruction signal to operate the first state changing unit 100 corresponding to the printing couple designated as operative in the current printing operation. The processing section 93 then outputs an operation signal output instruction signal to the printing couples whose inking and dampening arrangements 60 and 70 are designated as operative after the lapse of a predetermined time so as to operate the second state changing unit 110.

The operation signal output instruction signal from the processing section 93 is amplified in the operation signal output section 94, and output as an operation signal to operate the corresponding first state changing unit 100 and the second state changing unit 110.

With the operation of the first state changing unit 100 by the operation signal, the plate cylinder PC and the blanket cylinder BC constituting the printing couple are caused to make contact with each other, and the blanket cylinders BC of the adjoining printing couple are also caused to make contact with each other.

With the operation of the second state changing unit 110, the inking transmission means 50 is connected to the drive means MO for driving the corresponding printing couple via the power connecting unit CL. With this, the form roller connecting/disconnecting unit 62 is actuated, causing the form rollers 61 and 61 to move to the ink feeding position at which ink is fed to the printing plate surface of the plate cylinder PC by making contact with the printing plate surface, and the form damping roller connecting/disconnecting unit 72 is actuated, causing the form damping rollers 71 and 71 to move to the damping water feeding position at which dampening water is fed to the printing plate surface of the plate cylinder PC by making contact with the printing plate surface.

Upon completion of the operation control by the operation control section 9, the rotary press performs the aforementioned printing operation on the basis of the operation signals, such as start, acceleration/deceleration and stop, input by the input operation section 11 of the master control section 1, and a folded printed material is discharged from the folding unit FD. The printed material discharged from the folding unit FD. The printed material discharged from the folding unit FD is detected by the detecting section 87 provided at an appropriate predetermined position.

The detecting section 87 outputs a detection signal to the print copy counting section 84 every time the printing material is detected.

The printing control section 8 operates in the following manner during printing operation. That is, the print copy counting section 84, to which a value obtained by subtracting the "number of effective printing material upstream of the predetermined detecting position at which printing materials are detected" from the required number of printing materials in the current printing operation is set via the processing section 83, the print copy counting section 84 performs a first calculation to the subtract "1" from the set value every time of receiving a detecting signal from the detecting section 87, and output the calculation result to the processing section 83.

The processing section 83 recognizes the printing operation speed at that point of time as the drive reference output by the master control section 1 via the network connecting section 81 is input at all times, and when the drive means MO that has been stopped at that point of time is driven via the slave control section 2 at the monotonously increasing reference speed in the monotonously increasing/decreasing reference speed setting section 19 on the basis of the monotonously increasing pulse signal generated by the monotonously increasing/decreasing pulse signal generating section 18 of the master control section 1, calculates the time elapsed until the drive means MO reaches the printing operation speed at that point of time, and calculates the number of printing material to be printed when the aforementioned printing operation is continued at the printing operation speed at that point of time for the calculated time.

The processing section 83 extracts from the memory section 85 a "predetermined constant" stored in the memory section 85, that is, a predetermined constant (integer) by setting a slightly larger number than the number of printing materials to be printed when the aforementioned printing operation is carried out at the maximum printing operation speed for a period of time considered necessary to adjust the phase of the drive means MO that is driven at the monotonously increasing reference speed from the stop state at that point of time and reaches the printing operation speed at that point of time so as to match the drive reference phase of the drive reference so that the drive means MO can continue the subsequent printing operation. The processing section 83 then performs a second calculation to subtract the calculated number of print copies and the "predetermined constant" from the value obtained in the aforementioned first calculation.

The processing section 83 then outputs a first signal when the second calculation value becomes less or equal "0," and outputs a second signal when the first calculation value becomes less or equal "0." The first signal is sent to the master control section 1 via the network connecting section 81, while the second signal to the master control section 1 via the network connecting section 81 and to the operation control section 9 via the first connecting section 86.

Figure 7:
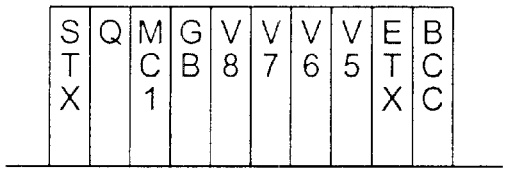
FIG. 7 is a typical example of a control message for driving and controlling the drive means corresponding to the slave control section belonging to each printing operation group.

In the master control section 1, the received first signal is sent from the master network connecting section 17 to the processing section 12. Upon receipt of the first signal, the processing section 12 actuates the monotonously increasing/decreasing pulse signal generating section 18 to generate a monotonously increasing pulse signal, sets the monotonously increasing reference speed on the basis of the monotonously increasing pulse signal in the monotonously increasing/decreasing reference speed setting section 19, and transmits a control message as shown in FIG. 7 to the slave control section 2 that belongs only to the succeeding printing operation group.

This control message comprises a text message having "Q" indicating that this message concerns the monotonously increasing/decreasing reference speed, "MC1" denoting the master control section 1 that is a controlling entity, "GB" denoting the group designated as operative, and "V8" through "V5" denoting the monotonously increasing reference speed inserted between the start code "STX" and end code "ETX" of the message, with a block check "BCC" suffixed to the text message. "V8" through "V5" here use ASCII character sets of "0" through "9" and "A" through "F," and the monotonously increasing reference speed in the message shown comprises 4 bytes, for example. Note that the drive reference phase is omitted in this control message.

This control message is transmitted over the network line 4 at a rate of 20 megabits per second, for example.

Upon receipt of the control message, each slave control section 2 processes the control message in the same manner as in the case where the drive reference comprising the drive reference speed and the drive reference phase, as noted earlier. Note that when the drive reference phase is omitted as in this control message, the phase deviation detecting section 24 outputs a signal denoting that the phase deviation is zero (0).

Figure 8:
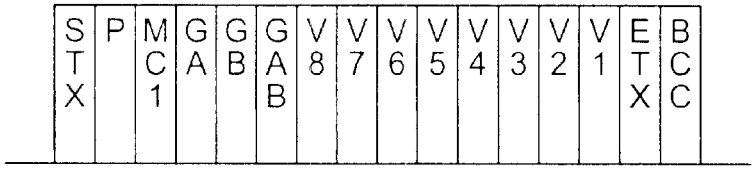
FIG. 8 is a typical example of a control message for driving and controlling the drive means corresponding to the salve control section belonging to each printing operation group.

When the master control section 1 finds that the monotonously increasing reference speed it outputs agrees with the drive reference speed of the drive reference (the printing operation speed at that point of time) transmitted, in parallel with the monotonously increasing reference speed, to the slave control section 2 belonging only to the preceding printing operation group and the slave control section 2 belonging to both the preceding and succeeding printing operation groups, the master control section 1 switches over the contents of the control message to the slave control section 2 belonging only to the succeeding printing operation group to which the monotonously increasing reference speed has been transmitted to the same contents as those of the drive reference output to the slave control section 2 belonging only to the preceding printing operation group and the slave control sections 2 belonging to both the preceding and succeeding printing operation groups. That is, the master control section 1 outputs a control message as shown in FIG. 8. The control message shown in FIG. 8 is such that a group belonging only to the succeeding printing operation is added to the groups designated as operative in the control message shown in FIG. 6.

With the completion of the first calculation, the printing control section 8 then outputs a second signal to the master control section 1 and the operation control section 9.

In the operation control section 9, the received second signal is input from the network connecting section 91 to the processing section 93.

The processing section 93 outputs an operation signal output instruction signal for operating the second state changing units 110 in the printing section P driven by the drive means MO corresponding to the slave control section 2 belonging only to the preceding printing operation group and in the printing section P driven by the drive means MO corresponding to the slave control section 2 belonging only to the succeeding printing operation group, and the operation signal output section 94 outputs an operation signal to the second state changing unit 110 of each of the aforementioned printing sections in accordance with this signal output.

In the printing section P driven by the drive means MO corresponding to the slave control section 2 belonging only to the preceding printing operation group, which the second state changing unit 110 has actuated in accordance with the operation signal, the operation of the ink pump group 63 and the dampening water injection nozzle group 37 is stopped, the form rollers 61 and 61 are moved to the ink non-feeding position, and the form damping roller 71 is moved to the dampening water non-feeding position.

In the printing section P driven by the drive means MO corresponding to the slave control section 2 belonging only to the succeeding printing operation group, which the second state changing unit 110 has actuated, the operation of the ink pump group 63 and the dampening water injection nozzle group 73 is started, the form rollers 61 and 61 are moved to the ink feeding position, and the form damping roller 71 is moved to the dampening water feeding position.

After the lapse of a predetermined time enough to complete the operation of the second state changing unit 101 in each printing section P, the processing section 93 outputs an operation signal output instruction signal for operating the first state changing units 100 in the printing section P driven by the drive means MO corresponding to the slave control section 2 belonging only to the preceding printing operation group and in the printing section P driven by the drive means MO corresponding to the slave control section 2 belonging only to the succeeding printing operation group, and the operation signal output section 94 outputs an operation signal to the first state changing unit 100 of each printing section P in accordance with this signal output.

In the printing section P driven by the drive means MO corresponding to the slave control section 2 belonging only to the preceding printing operation group, which the first state changing unit 100 has actuated upon receipt of this operation signal, the printing cylinder is moved to the non-printing position.

In the printing section P driven by the drive means MO corresponding to the slave control section 2 belonging only to the succeeding printing operation group, which the first state changing unit 100 has actuated upon receipt of this operation signal, the printing cylinder is moved to the printing position.

In the master control section 1, the received second signal is input from the master network connecting section 17 to the processing section 12.

Figure 9:
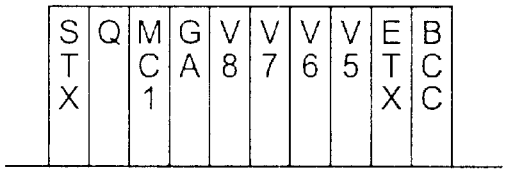
FIG. 9 is a typical example of a control message for driving and controlling the drive means corresponding to the slave control section belonging to each printing operation group.

The processing section 12 than generates a monotonously decreasing pulse signal by operating the monotonously increasing/decreasing pulse signal generating section 18 after the lapse of a predetermined time enough to complete the operation of the first state changing units 100 in the printing section P driven by the drive means MO corresponding to the slave control section 2 belonging only to the preceding printing operation group and in the printing section P driven by the drive means MO corresponding to the slave control section 2 belonging only to the succeeding printing operation group in accordance with the signal output by the operation control section 9, sets the monotonously decreasing reference speed on the basis of the monotonously decreasing pulse signal in the monotonously increasing/decreasing reference speed setting section 19, and transmits a control message as shown in FIG. 9 to the slave control section 2 that belongs only to the preceding printing operation group. The control message shown in FIG. 9 is such that the code denoting the group designated as operative in the control message shown in FIG. 7 was changed from "GB" to "GA." "V8" and "V5" in the control message denote the monotonously decreasing reference speed.

Figure 10:
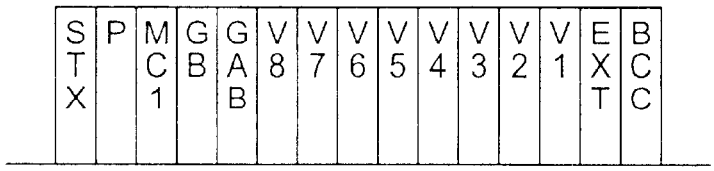
FIG. 10 is a typical example of a control message for driving and controlling the drive means corresponding to the slave control section belonging to each printing operation group.

At the same time, the master control section 1 changes the control message shown in FIG. 8 to the control message shown in FIG. 10, and transmits it in parallel with the control message shown in FIG. 9. The control message shown in FIG. 10 is such that the group belonging only to the preceding printing operation was excluded from the groups designated as operative in the control message shown in FIG. 8.

These control messages are transmitted over the network line 4 at a rate of 20 megabits per second, for example.

In the slave control section 2 belonging only to the preceding printing operation group, which has received the control message shown in FIG. 9, the processing of the control message is the same as the aforementioned processing of the control message shown in FIG. 7 in that the same processing is carried out as in the case where the drive reference comprising the drive reference speed and the drive reference phase is input, and the phase deviation detecting section 24 outputs a signal denoting that the phase deviation is zero. That is, the drive means MO corresponding to the slave control section 2 belonging only to the preceding printing operation group is decelerated and brought to a halt.

After the control message shown in FIG. 10 has been received, the slave control section 2 belonging to the succeeding printing operation group and the slave control section 2 belonging to both the preceding and succeeding printing operation groups carry out the same processing as in the past, and control the corresponding drive means MO in the same manner as in the past.

By carrying out the abovementioned control, a preceding printing operation is smoothly taken over to a succeeding printing operation without interrupting the operation of the rotary press.

Although the above description deals with the case where two different printing operation are carried out continuously, i will be apparent from the foregoing description that any number of different printing operations can be carried out in the same manner. Needless to say, when carrying out several different printing operation continuously, printing plates can be changed as necessary in the printing section that is stopped after the completion of a preceding printing operation.

Furthermore, the foregoing description deals with the case where the processing section 12 of the master control section 1, the processing section 83 of the operation control section 8, and the processing section 93 of the operation control section 9 are provided as separate units, there can be an arrangement where a single processing section serves as the processing section 12 of the master control section 1 and the processing section 82 of the printing control section 8, or a single output operation section serves as the input operation section 11 of the master control section 1 and the input operation section 82 of the printing control section 8.

As described above, the present invention makes it possible to change a plate cylinder used in the preceding printing operation to another plate cylinder used in the succeeding printing operation without interrupting the operation of the rotary press.

Even when plate cylinders are changed, generation of unwanted printed materials (spoilage) can be reduced to the minimum, leading to an efficient printing of multiple types of printed materials. The present invention also makes it possible to minimize the generation of unnecessary printing materials (spoilage) even when changing plate cylinders, print multiple kinds of printing materials efficiently, and extremely severely control of printing operation, aimed at reducing unwanted printed materials (spoilage) that has heretofore been impossible. The present invention is also very effectively in reducing running costs and improving productivity.

What is claimed is:

1. A control apparatus for automatically changing plate cylinders for use in rotary press providing a plurality of printing units, wherein each printing unit comprises at least a plate cylinder and an ink feeder to the printing plate surface on the outer periphery of the plate cylinder, a printing drive unit to drive at least a plate cylinder, a first state changing unit to individually change at least each plate cylinder from a printing state enabling printing to a non-printing state disabling printing, a second state changing unit to change each ink feeder from an ink feeding state enabling ink feeding to the printing plate surface to an ink non-feeding state disabling ink feeding, wherein the apparatus comprising:

a reference control section performing an input operation of at least an operation instruction for a printing operation, such as start, acceleration/deceleration and stop, outputting a drive reference corresponding to the operation instruction, and selectively outputting a monotonously increasing reference speed that monotonously increases at a predetermined gradient and a monotonously decreasing reference speed that monotonously decreases at a predetermined gradient, aside from the outputting of the drive reference;

a drive control section being provided for each printing drive unit for controlling the rotation of the printing drive unit on the basis of a signal from the reference control section;

a printing control section setting a required number of print copies for a printing operation, carrying out a first calculation where "1" is subtracted from the required number of print copies for the printing operation every time a printing material is detected at a predetermined detecting position and a second calculation where a period of time for a currently stopped printing drive unit to be driven at the monotonously increasing reference speed and reach a printing operation speed at that point of time in the printing operation is calculated, calculating the number of printing materials to be printed when the printing operation at that point of time is continued for the calculate period of time, and subtracting at all time the sum of the calculated number of printing materials and a predetermined constant from the value obtained in the first calculation, outputting a first signal when a value obtained in the second calculation becomes less or equal "0," and outputting a second signal when a value obtained as the calculation result of the first calculation becomes less or equal "0;" and an operation control section outputting a state changing signal for operating the first state changing unit to change the state of plate cylinders, and the second state changing unit to change the state of the ink feeder, Wherein the drive control section outputting the monotonously increasing reference speed in response to the output of the first signal in a predetermined relationship, and outputting the monotonously decreasing reference speed in response to the output of the second signal in a predetermined relationship, and the operation control section outputting an operation signal for operating the first state changing unit and the second state changing unit in response to the output of the second signal in a predetermined relationship.

2. A control apparatus according to claim 1, wherein the reference control section designates a printing section to be used in a first printing operation, or distinctively a printing section to be newly used and a standing printing section to be used continuously.

3. A control apparatus according to claim 1, wherein the printing control section is provided in such a manner that the number of effective printing materials upstream of a predetermined detecting position for detecting printing materials can be set, and that the number of effective printing materials upstream of the predetermined detecting position can be subtracted from the required number of print copies for the printing operation during the first calculation.

4. A control apparatus according to claim 1, wherein the reference control section is provided as a master control unit, and the drive control section is provided as a slave control unit subordinate to the master control unit.

5. A control method for automatically changing plate cylinders for use in a rotary press providing a plurality of printing units, wherein each printing unit comprises at least a plate cylinder and an ink feeder to the printing plate surface on the outer periphery of the plate cylinder, a printing drive unit to drive at least a plate cylinder, a first state changing unit to individually change at least each plate cylinder from a printing state enabling printing to a non-printing state disabling printing, a second state changing unit to change each ink feeder from an ink feeding state enabling ink feeding to the printing plate surface to an ink non-feeding state disabling ink feeding, the method comprises the steps of:

performing an input operation of at least an operation instruction for a printing operation, such as start, acceleration/deceleration and stop, outputting a drive reference corresponding to the operation instruction, and selectively outputting a monotonously increasing reference speed that monotonously increases at a predetermined gradient and a monotonously decreasing reference speed that monotonously decreases at a predetermined gradient, aside from the outputting of the drive reference;

being provided for each printing drive unit for controlling the rotation of the printing drive unit on the basis of a signal from a reference control section;

setting a required number of print copies for said printing operation, carrying out a first calculation where "1" is subtracted from the required number of print copies for the printing operation every time a printing material is detected at a predetermined detecting position and a second calculation where a period of time for a currently stopped printing drive unit to be driven at the monotonously increasing reference speed and reach a printing operation speed at that point of time in the printing operation is calculated, calculating the number of printing materials to be printed when the printing operation at that point of time is continued for the calculated period of time, subtracting at all times the sum of the calculated number of printing materials and a predetermined constant from the value obtained in the first calculation, and outputting a first signal when a value obtained in the second calculation becomes less or equal "0" and outputting a second signal when a value obtained as the calculation result of the first calculation becomes less or equal "0;" and outputting a state changing signal for operating the first state changing unit for changing the state of plate cylinders, and the second state changing unit for changing the state of the ink feeding means feeding ink, wherein a drive control section outputs the monotonously increasing reference speed in response to the output of the first signal in a predetermined relationship and outputs the monotonously decreasing reference speed in response to the output of the second signal in a predetermined relationship, and an operation control section outputs an operation signal for operating the first state changing unit and the second state changing unit in response to the output of the second signal in a predetermined relationship.

6. A rotary press capable automatically changing plate cylinders comprising:

a plurality of printing units, wherein each printing unit comprises at least a plate cylinder and an ink feeder to the printing plate surface on the outer periphery of the plate cylinder;

a printing drive unit to drive at least a plate cylinder;

a first state changing unit to individually change at least each plate cylinder from a printing state enabling printing to a non-printing state disabling printing, a second state changing unit to change each ink feeder from an ink feeding state enabling ink feeding to the printing plate surface to an ink non-feeding state disabling ink feeding; and a control apparatus further comprises:

a reference control section performing an input operation of at least on operation instruction for a printing operation, such as start, acceleration/deceleration and stop, outputting a drive reference corresponding to the operation instruction, and selectively outputting a monotonously increasing reference speed that monotonously increases at a predetermined gradient and a monotonously decreasing reference speed that monotonously decreases at a predetermined gradient, aside from the outputting of the drive reference, a drive control section being provided for each printing drive unit for controlling the rotation of that printing drive unit on the basis of a signal from the reference control section, a printing control section setting a required number of print copies for a printing operation, carrying out a first calculation where "1" is subtracted from the required number of print copies for the printing operation every time a printing material is detected at a predetermined detecting position and a second calculation where a period of time for a currently stopped printing drive unit to be driven at the monotonously increasing reference speed and reach a printing operation speed at that point of time in the printing operation is calculated, calculating the number of printing materials to be printed when the printing operation at that point of time is continued for the calculated period of time, and subtracting at all times the sum of the calculated number of printing materials and a predetermined constant from the value obtained in the first calculation, outputting a first signal when a value obtained in the second calculation becomes less or equal "0," and outputting a second signal when a value obtained as the calculation result of the first calculation becomes less equal "0;" and an operation control section outputting a state changing signal for operating the first state changing unit to change the state of plate cylinders, and the second state changing unit to change the state of the ink feeder, wherein the drive control section outputting the monotonously increasing reference speed in response to the output of the first signal in a predetermined relationship, and outputting the monotonously decreasing reference speed in response to the output of the second signal in a predetermined relationship, and the operation control section outputting an operation signal for operating the first state changing unit and the second state changing unit in response to the output of the second signal in a predetermined relationship.

7. A method for controlling a printing press, the method comprising the steps of:

providing first and second printing units;

operating said first printing unit to print a predetermined number of copies;

counting a number of copies being printed by said first printing unit;

subtracting the number of copies printed from the predetermined number of copies to determine the remaining number of copies needed;

determining a "time to speed" for said second printing unit to reach operating speed from a stopped state; measuring an operating speed of said first printing unit;

calculating an end number of copies said first printing unit can print at said operating speed during the "time to speed" of said second printing unit;

calculating a second unit start signal by subtracting said end number of copies from said remaining number of copies needed;

starting operation of said second printing unit when said second unit start signal is less than or equal to zero;

stopping operation of said first printing unit when said remaining number of copies needed is less than or equal to zero.

8. A method in accordance with claim 7, wherein:

said counting, said subtracting, said measuring and said calculating are preformed substantially continuously during operation of said first printing unit.

9. A method in accordance with claim 7, wherein:

said operating speed of said first printing unit varies during operation of said first printing unit.

10. A method in accordance with claim 8, wherein:

said operating speed of said first printing unit varies during operation of said first printing unit.

* * * * *